US005539271A

United States Patent [19]

Sulcs et al.

[11] Patent Number: 5,539,271

[45] Date of Patent: Jul. 23, 1996

[54] HORIZONTAL BURNING METAL HALIDE LAMP

[75] Inventors: Juris Sulcs, Chagrin Falls; Dennis S. Bradley, Akron, both of Ohio

[73] Assignee: Venture Lighting International, Inc., Solon, Ohio

[21] Appl. No.: 354,425

[22] Filed: Dec. 12, 1994

[51] Int. Cl.[6] ..... H01J 61/30

[52] U.S. Cl. ..... 313/25; 313/634; 313/621

[58] Field of Search ..... 313/25, 623, 634, 313/621, 318.02, 44

[56] References Cited

U.S. PATENT DOCUMENTS 5,055,740 10/1991 Sulcs ..... 313/623

FOREIGN PATENT DOCUMENTS 0581359 2/1994 European Pat. Off. .
5217555 8/1993 Japan .

*Primary Examiner*—Nimeshkumar D. Patel
*Attorney, Agent, or Firm*—J. F. McDevitt

[57] ABSTRACT

An improved arc tube for a horizontal burning metal halide arc discharge lamp is disclosed to avoid light output fluctuations which otherwise occur during lamp operation. The improved arc tube construction employs opposing planar pinch seal regions which are angularly displaced with respect to each other while further positioning the opposing discharge electrodes below the longitudinal central axis of the arc tube member.

19 Claims, 4 Drawing Sheets

HORIZONTAL BURNING METAL HALIDE LAMP

BACKGROUND OF THE INVENTION

This invention relates to metal halide arc discharge lamps generally and more particularly to a novel construction for such type lamp to provide improved illumination when operated from a generally horizontal position.

Metal halide arc discharge lamps are now employed globally as a source of highly efficient white and colored light in a wide variety of lighting applications. These versatile lamps can be used outdoors as well as indoors equally well with typical temperature extremes having little or no impact on illumination performance. Because these lamps also produce substantially less heat than incandescent lamps for a given light level, the heat reduction therefrom reduces the amount of energy required to cool an indoor lighted place. Their versatility, compact size and long life has further been recognized for replacement of high pressure sodium vapor lamps in existing fixtures without need to change ballasts, igniters or even replace the existing sockets in order to gain a source of more natural color illumination. Accordingly, these lamps have already been found useful over the widest possible range of lighting applications to include outdoor lighting of buildings, billboards, roadways and sport fields as well as indoor lighting of commercial offices, warehouses and manufacturing facilities.

When intended for operation in a horizontal position this type lamp can be constructed with position oriented base means such as a locating pin being affixed to a screw-in base member to provide a spatial engagement in the lamp fixture assisting the lamp performance. When operated in a horizontal orientation, still other factors not generally experienced with vertical lamp operation have been found to deter optimum lamp performance. To still further illustrate such distinct operational factors, there is disclosed in U.S. Pat. No. 5,055,740 a horizontal burning metal halide lamp construction which largely avoids most of the significant problems encountered with horizontal lamp orientation. More particularly, the disclosed lamp construction features a generally cylindrical arc tube member having electrodes at the ends positioned below the longitudinal central axis of the arc tube in combination with an asymmetric contour of the arc tube ends. A heat reflective coating of said arc tube ends is further disclosed in such prior art lamp construction to improve the lamp performance.

A still further serious operational problem has been found to exist with metal halide arc discharge lamps constructed in the foregoing manner upon being operated in a generally horizontal position. By "generally horizontal position" as used in the present application is meant a spatial orientation of the lamp device so that the longitudinal central axis of its arc tube during operation can be tilted above and below the horizontal axis by as much as sixty degrees. Specifically, it has now been found that horizontal operation of the conventional lamps is accompanied by a rapid fluctuation or wavering of the bowed arc discharge within the arc tube causing undesirable movement of light output from the lamp. The disconcerting nature in such rapid light movement is visibly observable hence could prove highly objectionable to both spectators and athletes at sporting events as well as to occupants of an industrial or commercial work place.

Accordingly, one object of the present invention is to obviate light output fluctuation in horizontal burning metal halide arc discharge lamps with a novel lamp construction.

It is another object of the present invention to provide an improved arc tube construction for a metal halide arc discharge lamp which is not subject to light output fluctuations during horizontal burning.

A still further object of the present invention is to provide a novel horizontal burning metal halide arc discharge lamp construction eliminating light output fluctuations by means of modifying the arc tube configuration during fabrication.

Still another object of the present invention is to provide a relatively simple modification in otherwise conventional lamp manufacture enabling improved construction of a horizontal burning metal halide arc discharge lamp.

These and still further objects of the present invention will become apparent upon considering the following detailed description for the present invention.

SUMMARY OF THE INVENTION

A novel arc tube member is now provided for a horizontal burning metal halide arc discharge lamp which eliminates light output fluctuation during lamp operation. In general, such improved arc tube construction now requires the otherwise conventional pinch seal regions disposed at opposite ends of the elongated cylindrically shaped arc tube to be angularly displaced with respect to each other. More particularly, the previous coplanar orientation of said pinch seal regions along the central longitudinal axis of the arc tube with each of said pinch seal regions having a planar configuration is now changed to produce angular displacement between the planes in which the respective pinch seal regions reside. Angular displacement of the respective pinch seal regions in this manner up to a maximum ninety degree angle entirely eliminates the undesirable light fluctuation in arc tube constructions having discharge electrodes sealed at opposite ends of the hollow arc tube member and with both discharge electrodes being positioned below the aforementioned arc tube axis. In a preferred arc tube construction, an exhaust tip-off is provided intermediate the pinch seal regions and the presently modified pinch seal regions are further angularly displaced with respect to said exhaust tip-off. Since a still different preferred arc tube construction according to the present invention employs asymmetric pinch seal regions and heat reflective coatings in the manner described in the previously identified U.S. Pat. No. 5,055,740 prior art patent, the entire contents of said patent are hereby specifically incorporated by reference into the present application. Fabrication of a fused quartz arc tube assembly having the above defined angularly displaced pinch seal regions can be provided in the customary manner following insertion of the discharge electrodes into the central cavity of the arc tube member. In doing so, the discharge electrodes can be sequentially sealed at the arc tube ends accompanied by thereafter exhausting the assembled construction and filling the central cavity with a suitable gaseous discharge medium to form the completed arc tube assembly. A representative horizontal burning metal halide arc discharge lamp embodiment employing the presently improved arc tube assembly encloses said arc tube assembly within an outer light transmissive envelope having a base member:affixed thereto which includes terminal means electrically connected to first inlead conductors and with the discharge electrodes contained in the arc tube being further electrically connected to second inlead conductors extending outwardly from the arc tube and being electrically connected to the first inlead conductors.

DETAILED DESCRIPTION OF THE PREFERRED EMBODIMENTS

Figure 1:
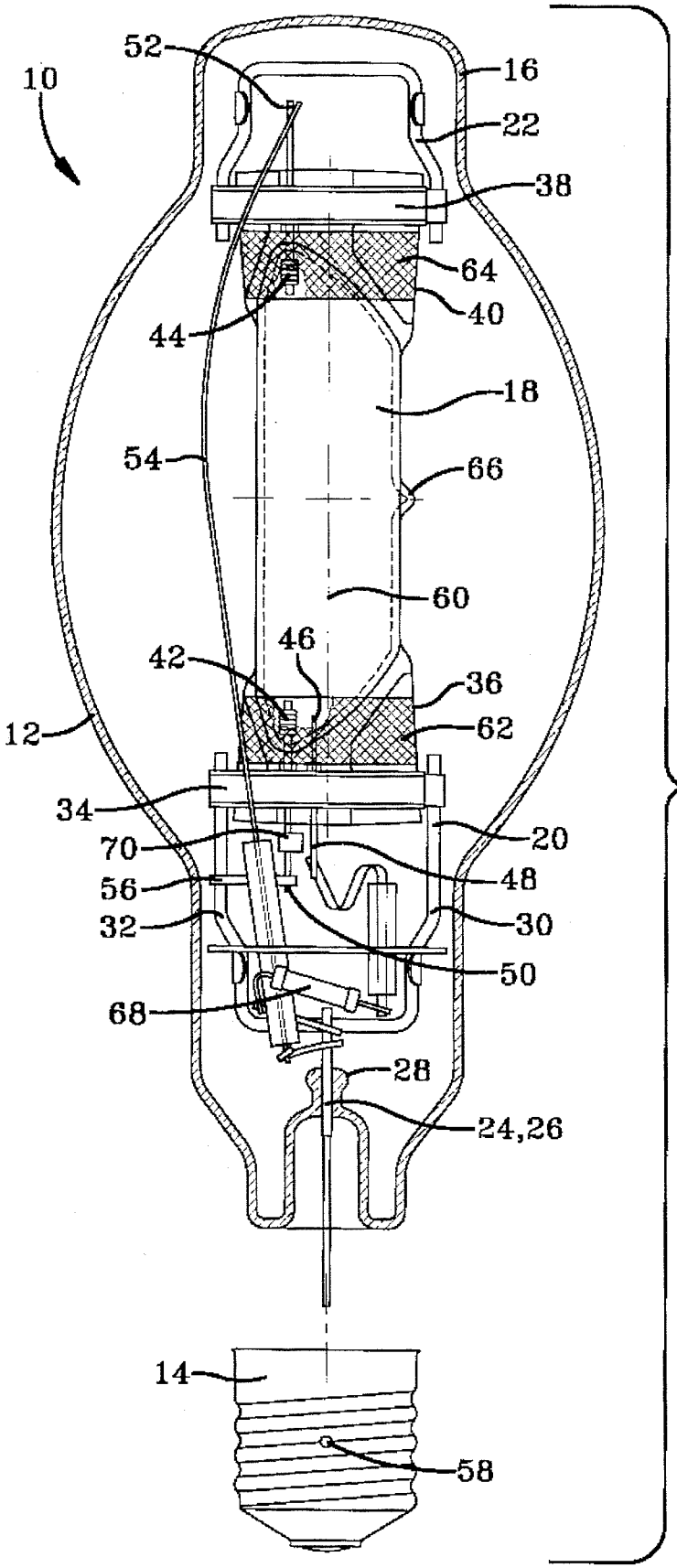
FIG-1 PRIOR ART
FIG. 1 is a side view depicting a prior art horizontal burning metal halide arc discharge lamp.

FIG. 1 is a cross sectional side view depicting a prior art representative horizontal burning metal halide arc discharge lamp 10 employing a conventional base construction as a means for doing so. More particularly, a metal halide type lamp is depicted which is particularly adapted for horizontal operation. The lamp 10 comprises an outer vitreous envelope 12 secured to a screw-in type conductive base member 14 at one end while further having a protuberance anchoring means 16 disposed at the opposite end. An arc tube assembly 18 is physically suspended within the outer envelope 12 by means of a two-part metal mount frame 20 and 22, which is electrically connected in part to lamp terminal means provided in base member 14. In said regard, such electrical connection is provided with first inlead conductors 24 and 26 extending outward from a conventional reentrant stem 28 to a pair of metal support rods or posts 30 and 32 forming the lower half 20 of the mount frame. Upper half 22 in said mount frame remains electrically isolated or insulated from the lamp terminal means other than when connected thereto during lamp operation by means of the arc discharge (not shown). Lower mount frame 20 includes a clamp 34 secured to bottom pinch seal region 36 of the arc tube member 18 while a similar clamp 38 is provided in the upper frame 22 and secured to upper pinch seal region 40 of the arc tube member as a structural means for its physical support. Arc tube member 18 includes spaced apart principal discharge electrodes 42 and 44 and a starting electrode 46 along with a suitable gaseous discharge medium including mercury and a metal halide (not shown). As herein shown, all discharge electrodes 42, 44 and 46 are individually connected to second inlead conductors 48, 50 and 52 at the respective pinch seal regions of the arc tube via thin refractory metal foil elements additionally located thereat. Still further electrical interconnection between the second inlead conductors 48, 50 and 52 and the first inlead conductors 26 and 28 is provided in the illustrated lamp embodiment. Inlead conductor 52 is connected to inlead conductor 26 with a curved wire element 54 whereas remaining inlead conductors 48 and 50 are separately connected to inlead conductors 24 and 26, respectively, with conductive metal strips 56 affixed to support rod 32 which is also connected to the latter inlead conductors. A protruding pin 58 affixed to base member 14 in the depicted lamp embodiment provides proper spatial orientation of said lamp for optimum performance when installed in a suitable mating socket fixture (not shown). As further shown in the drawing, both principal discharge electrodes 42 and 44 are positioned below the longitudinal central axis 60 of the arc tube 18 and with said arc tube member further including heat reflective coatings 62 and 64 being applied at both ends of the arc tube. The arc tube still further includes an exhaust tip-off 66 disposed intermediate the discharge electrodes which is desirably positioned uppermost in the arc tube during horizontal burning operation of the lamp.

The illustrated lamp embodiment is operated with external ballast means which can still further include housing some of the operating circuitry along with still other operating components within the outer envelope 12 of the lamp construction. For example, the depicted lamp embodiment includes gettering means (not shown) provided in outer envelope 12 to remove gases such as oxygen from undesirably oxidizing the inner lamp components. Additionally, there can be included starting resistor means 68 within the outer envelope which form a part of the lamp operating circuitry. The lamp is enabled by such operating circuit means to ionize vapor formed within the selected gaseous discharge medium in order to produce an arc discharge between the principal discharge electrodes 42 and 44 providing the output illumination. Initial ionization in the lamp occurs between starting electrode 46 and principal electrode 42 with a bimetallic switch element 70 operating to terminate energization of the starting electrode when an arc discharge is established between both principal discharge electrodes. Operation of the illustrated prior art lamp embodiment in the foregoing manner has uniformly been found to produce the objectionable light output fluctuations previously pointed out.

Figure 2A:
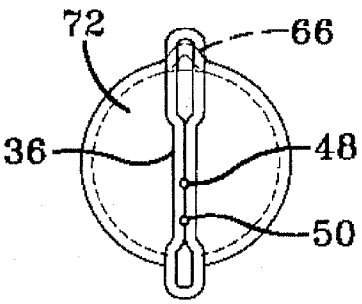
FIG-2A PRIOR ART
FIG. 2A is an end view of the FIG. 2 arc tube assembly.
Figure 2:
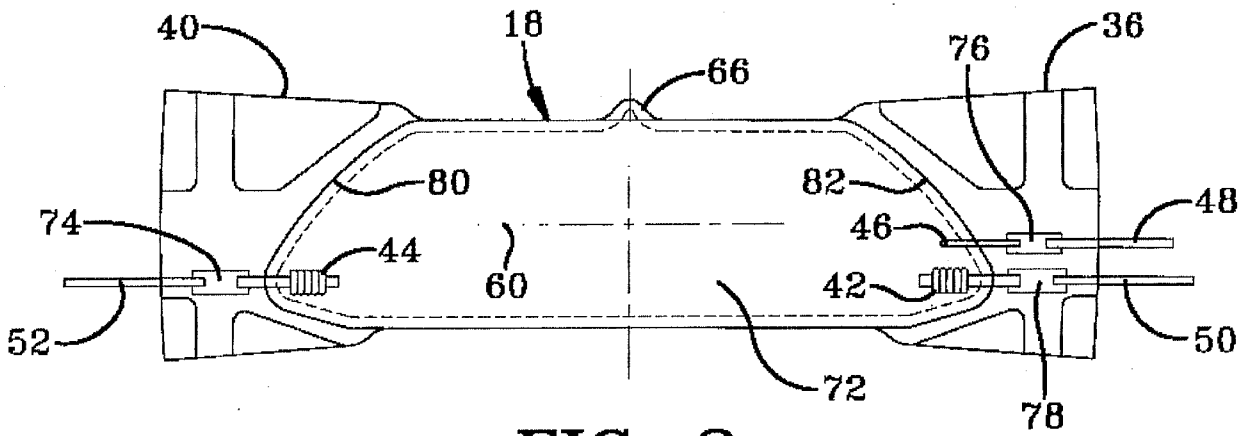
FIG-2 PRIOR ART
FIG. 2 is a side view of the arc tube assembly in the FIG. 1 lamp.

FIG. 2 provides art enlarged side view of the prior art arc tube construction 18 employed in FIG. 1. Accordingly, the same numerals employed in FIG. 1 are retained in the present drawing to identify common components of said construction. Said arc tube member 18 has an elongated cylindrical shape extending along a longitudinal central axis 60 with pinch seal regions 36 and 40 enclosing a central cavity 72. A pair of principal discharge electrodes 42 and 44 are disposed at opposite ends of the arc tube cavity 72 so as to both reside below the lamp longitudinal axis 60 while a further starting electrode 46 is positioned along said central axis at one of the pinch seal regions. Conventional electrical connection for all said discharge electrodes is made in the respective pinch seal regions by means of interconnection to thin refractory metal foil elements 74, 76 and 78 which in turn are connected to the inlead conductors 48, 50 and 52. As can be seen in the present drawing, both pinch seal regions 36 and 40 of said arc tube have a planar configuration formed during conventional fabrication and with both of said regions residing in the same vertical plane aligned along the lamp longitudinal axis 60. An exhaust tip-off 66 disposed intermediate said pinch seal regions further enables incorporation of a conventional gaseous discharge medium to be contained within the central cavity of said arc tube. Such discharge medium can thereby comprise a mixture of a rare gas such as argon, krypton or like rare gas along with mercury and various other metal substances including a vaporized metal halide compound. Such conventional metal halide lamps can further include alkaline metal or alkaline earth metal additives in the gaseous discharge medium along with still other metal substances forming a mercury amalgam to include metals selected from the group consisting of copper, zinc, cadmium, gallium, indium, thallium, silver, antimony and combinations thereof. Other metal additives can also be contained within the central arc tube cavity for different purposes including thorium additives for electrode activation and known gettering agents. As can further be noted in the present drawing, both arc tube cavity ends 80 and 82 employ the same type asymmetric configuration at the pinch seal regions which is more fully disclosed in the U.S. Pat. No. 5,055,740 prior art patent specifically incorporated herein. Conventional fabrication of the illustrated prior art arc tube construction is carried out with hollow tubing of a suitable vitreous material, such as quartz glass, having the discharge electrodes positioned at each tubing end. The discharge electrodes are hermetically sealed within the central cavity formed in the vitreous tubing length by a heat sealing operation conducted at both tubing ends wherein the molten vitreous material is pinched together mechanically with a cooperating set of jaw members. Such conventional pinch sealing operation is understandably conducted at sufficiently elevated temperatures to melt the vitreous material and form the internal cavity of the arc tube between the oppositely disposed pinch seal ends while further hermetically sealing the discharge electrodes within this cavity. While not included in the present drawing, said assembled prior art arc tube construction can thereafter be provided with the heat reflective coatings 62 and 64 previously depicted in FIG. 1.

In FIG. 2A, an end view is depicted of the prior art tube assembly described in FIG. 2. Pinch seal region 36 is shown having second inlead conductors 48 and 50 protruding outwardly therefrom while exhaust tip-off 66 is shown only in phantom as being positioned rearwardly from said pinch seal region. Remaining pinch seal region 40 at the opposite end of arc tube cavity 72 is entirely absent from the present drawing by reason of being aligned along the same vertical plane in which the depicted pinch seal region resides.

Figure 3A:
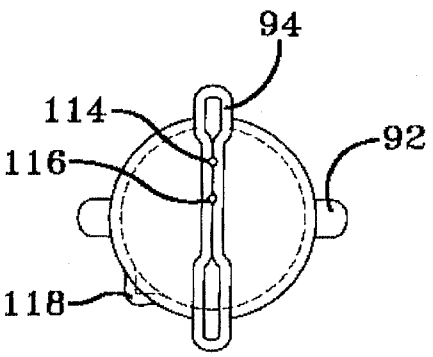
FIG. 3A is an end view of the FIG. 3 arc tube assembly.
Figure 3:
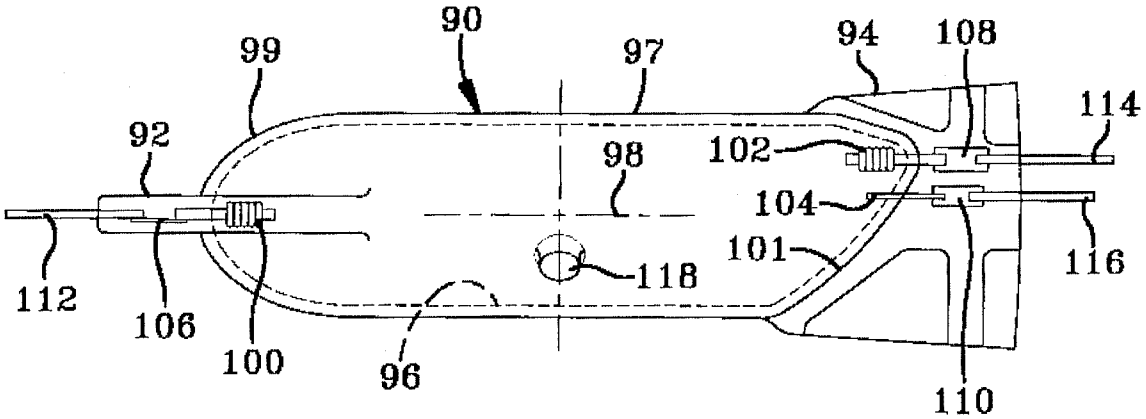
FIG. 3 is a side view for a representative arc tube assembly according to the present invention.

There is depicted in FIG. 3 an improved arc tube assembly 90 which eliminates light output fluctuations when operated in a horizontal burning metal halide lamp employing such are tube construction. Accordingly, the arc tube assembly 90 includes end pinch seal regions 92 and 94 to hermetically seal the central cavity portion 96 of the arc tube member 97. The opposing ends 99 and 101 of said central cavity can also be seen to have the same or similar asymmetric contour as disclosed in the previously identified U.S. Pat. No. 5,055,740 patent. Central cavity 96 again has a hollow cylindrical shape centrally disposed about a longitudinal axis 98. Disposed below said longitudinal axis 98 is a pair of discharge electrodes 100 and 102 with a further starting electrode 104 also being aligned below this axis. All electrodes 100, 102 and 104 are again electrically connected in the respective pinch seal regions to individual thin refractory metal foil elements 106, 108 and 110, respectively, which are further interconnected to respective inlead conductors 112, 114 and 116. As can be noted in the present drawing, however, opposing pinch seal regions 92 and 94 in said arc tube embodiment are now disposed in an offset relationship with respect to each other so as provide an approximately ninety degree angular displacement therebetween. As still further distinct from the herein above described prior art are tube construction, it can also be noted from the present drawing that exhaust tip-off element 118 in the present arc tube is now positioned at a location angularly displaced with respect to both pinch seal regions. A filling of the central cavity 96 in the present arc tube member with a suitable gaseous discharge medium, such as hereinbefore disclosed, completes fabrication of the herein illustrated embodiment.

FIG. 3A is an end view of the presently improved FIG. 3 arc tube assembly. As depicted, pinch seal region 94 again resides in a vertical plane having inlead conductors 114 and 116 protruding outwardly therefrom. Opposing pinch seal region 92 can now be seen to reside in a horizontal plane, however, so that an approximately ninety degree angular displacement exists between the depicted pinch seal regions. It can further be noted that exhaust tip-off 118 is angularly displaced with respect to both of said depicted pinch seal regions.

Figure 4:
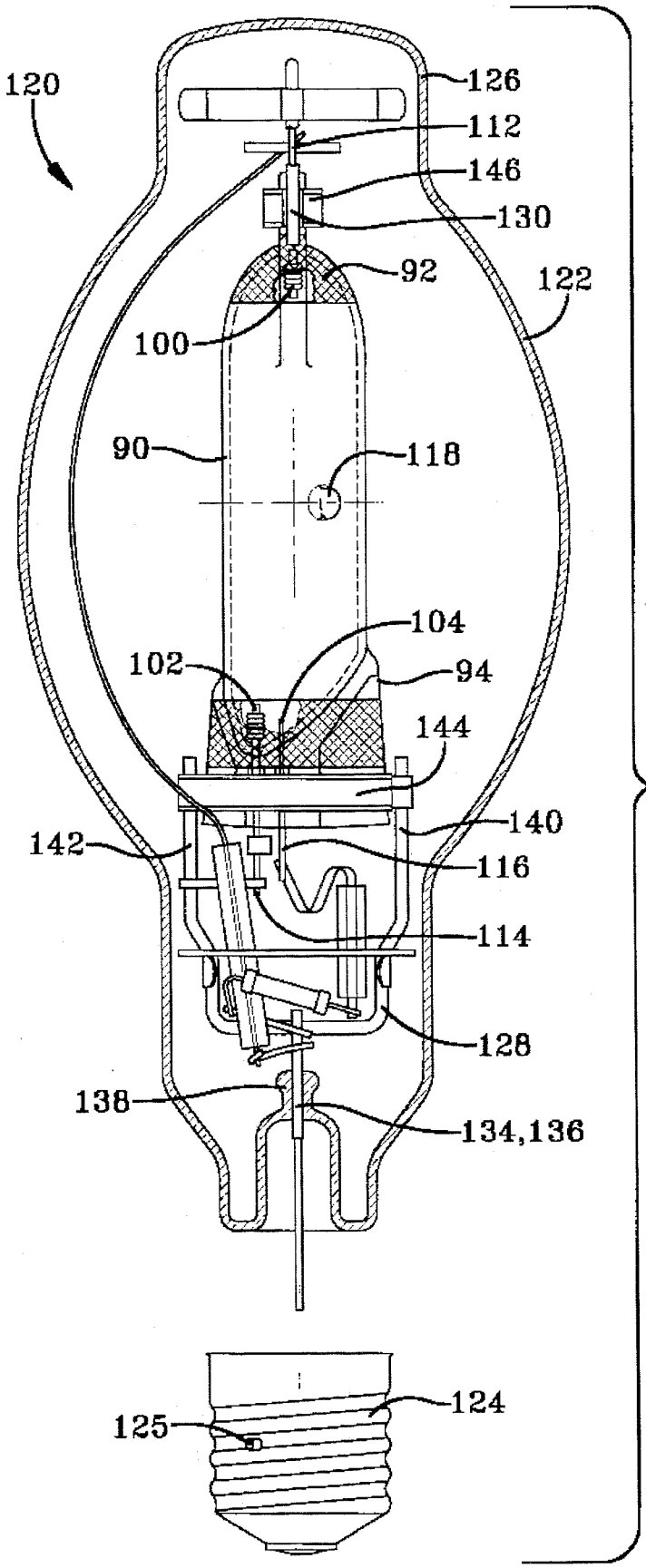
FIG. 4 is a side view for a representative horizontal burning metal halide arc discharge lamp employing the FIG. 3 arc tube assembly.

FIG. 4 is a side view depicting a representative horizontal burning metal halide arc discharge lamp 120 employing the arc tube assembly described above in FIG. 3. More particularly, said lamp 120 employs an outer vitreous envelope 122 secured again to a screw-in conductive base member 124 at one end while similarly having a protuberance anchoring means 126 disposed at its opposite end. Conductive base member 124 again includes a projecting pin 125 affixed thereto for lamp positioning during operation. Arc tube 90 is physically suspended within the outer envelope 122 again by means of two-part metal mount frame 128 and 130 which is electrically connected in part to lamp terminal means provided in base member 124. The electrical connection is provided with first inlead conductors 134 and 136 extending again from conventional reentrant stem 138 to a pair of metal support rods 140 and 142 forming the lower half of the mount frame. Lower mount frame member 128 includes a clamp 144 secured to bottom pinch seal region 94 of the arc tube 90 while a similar clamp 146 is provided in the upper frame member 130 at the opposing pinch seal region 92 of the arc tube to secure its physical support. As hereinabove described, arc tube 90 has all discharge electrodes 100, 102 and 104 individually connected to second inlead conductors 112, 114 and 116 at the respective pinch seal regions of the arc tube. It can also be seen in the present drawing that remaining interconnection between the second and first inlead conductors of the present lamp embodiment is carried out by the same means previously disclosed for the prior art lamp embodiment in FIG. 1. Additionally, the arc tube member in the present improved lamp construction can again optionally be provided with the previously described heat reflective coatings. Operation of the herein illustrated improved lamp embodiment in the manner also previously disclosed finds entirely no light output fluctuations being experienced.

It will be apparent from the foregoing description that a generally improved means has been provided to minimize light fluctuation in horizontal burning metal halide arc discharge lamps. It is contemplated that modification can be made in the specific lamp configurations and arc tube constructions than herein illustrated, however, without departing from the spirit and scope of the present invention. For example, these lamps may employ other already known basing constructions, arc tube support means, lamp outer envelope shapes and sizes, specialized ballasting circuitry and still other lamp variations. Similarly, other already known arc tube constructions can also be benefited by adoption of the presently improved means. Accordingly it is intended to limit the present invention only by the scope of the appended claims.

What we claim as new and desire to secure by Letters Patent of the United States is:

1. In a metal halide arc discharge lamp for operation in a generally horizontal position including an elongated cylindrically shaped arc tube having discharge electrodes sealed at opposite ends of a central cavity in pinch seal regions, the discharge electrodes being positioned below the longitudinal axis of the arc tube, the improvement wherein the pinch seal regions each have a planar configuration aligned along the longitudinal axis of the arc tube but which are angularly displaced with respect to each other to establish an offset relationship between the discharge electrodes sealed therein.

2. The lamp of claim 1 wherein the pinch seal regions are angularly displaced with respect to each other up to a maximum 90 degree angle.

3. The lamp of claim 1 wherein the arc tube further includes an exhaust tip-off positioned intermediate the pinch seal regions.

4. The lamp of claim 3 wherein both pinch seal regions are further angularly displaced with respect to the exhaust tip-off.

5. The lamp of claim 1 wherein the central cavity of the arc tube has asymmetric contour at the pinch seal regions.

6. The lamp of claim 1 wherein the arc tube ends are provided with a heat reflective coating.

7. An arc tube for a metal halide arc discharge lamp being operated in a generally horizontal position comprising a hollow elongated cylindrically shaped body member of vitreous light transmissive material having discharge electrodes sealed at opposite ends of a central cavity in pinch seal regions, the discharge electrodes being positioned below the longitudinal axis of the body member, an exhaust tip-off positioned intermediate the pinch seal regions, the pinch seal regions each having a planar configuration aligned along the longitudinal axis of the body member while being angularly displaced with respect to each other and the exhaust tip off, the central cavity of the body member having an assymetric contour at both pinch seal regions, and the discharge electrodes having an offset relationship with respect to each other.

8. A metal halide arc discharge lamp for operation in a generally horizontal position comprising:

(a) an outer light transmissive envelope having a base member affixed thereto which includes terminal means electrically connected to first inlead conductors, (b) an inner elongated cylindrically shaped hollow arc tube of vitreous light transmissive material having discharge electrodes being sealed at opposite ends of a central cavity in pinch seal regions, the discharge electrodes being positioned below the longitudinal axis of the arc tube while further being electrically connected to second inlead conductors extending outwardly from the arc tube and being electrically connected to the first inlead conductors, with the arc tube further containing a gaseous discharge medium which includes mercury and metal halides, and (c) the pinch seal regions each having a planar configuration aligned along the longitudinal axis of the arc tube but which are angularly displaced with respect to each other to establish an offset relationship between the discharge electrodes sealed therein.

9. The lamp of claim 8 wherein the pinch seal regions are angularly displaced with respect to each other up to a maximum 90 degree angle.

10. The lamp of claim 8 wherein the arc tube further includes an exhaust tip-off positioned intermediate the pinch seal regions.

11. The lamp of claim 10 wherein both pinch seal regions are further angularly displaced with respect to the exhaust tip-off.

12. The lamp of claim 8 wherein the central cavity of the arc tube has an asymmetric contour at the pinch seal regions.

13. The lamp of claim 8 wherein the arc tube ends are provided with a heat reflective coating.

14. The lamp of claim 8 wherein the arc tube is quartz glass.

15. The lamp of claim 14 wherein the discharge electrodes are interconnected in the pinch seal regions to the second inlead conductors with thin refractory metal foil elements.

16. The lamp of claim 8 wherein the discharge electrodes further include a starting electrode.

17. A metal halide arc discharge lamp for operation in a generally horizontal position comprising:

(a) an outer light transmissive vitreous envelope having a screw base member affixed thereto which includes terminal means electrically connected to a pair of first inlead conductors, (b) an inner elongated cylindrically shaped hollow arc tube of vitreous light transmissive material having a pair of discharge electrodes sealed at opposite ends of a central cavity in i pinch seal regions, a startling electrode sealed in one of the pinch seal regions, an exhaust tip-off positioned intermediate the pinch seal regions, the discharge electrodes being positioned below the longitudinal axis of the arc tube, each of the discharge electrodes and the starting electrode being electrically connected to a respective one of second inlead conductors, each of the second lead conductors extending outwardly from the arc tube and being electrically connected to a respective one of the first inlead conductors, the arc tube further containing a gaseous discharge medium which includes mercury and metal halides, (c) the pinch seal regions each having planar configuration aligned along the longitudinal axis of the arc tube while being angularly displaced with respect to each other and the exhaust tip-off, the discharge electrodes having an offset relationship with respect to each other, and (d) the central cavity of the arc tube having an asymmetric contour at both pinch seal regions.

18. The lamp of claim 17 wherein the arc tube ends are provided with a heat reflective coating.

19. The lamp of claim 17 wherein both discharge and starting electrodes are interconnected in the press seal regions to the second inlead conductors with thin refractory metal foil elements.

* * * * *